US005229024A

United States Patent [19]

Corbin

[11] Patent Number: 5,229,024

[45] Date of Patent: Jul. 20, 1993

[54] APPARATUS FOR MAKING CONCRETE PIPE

[75] Inventor: Mark R. Corbin, Sioux City, Iowa

[73] Assignee: International Pipe Machinery Corp., Sioux City, Iowa

[21] Appl. No.: 732,894

[22] Filed: Jul. 19, 1991

[51] Int. Cl.[5] ..... B28B 21/76

[52] U.S. Cl. ..... 249/65; 249/100; 249/144

[58] Field of Search ..... 249/11, 65, 100, 144

[56] References Cited

U.S. PATENT DOCUMENTS

| | | | |
|---|---|---|---|
| 2,929,124 | 3/1960 | James | 249/100 |
| 2,966,713 | 1/1961 | Billner | 249/100 |
| 3,941,347 | 3/1976 | Robertson et al. | 249/100 |
| 4,123,033 | 10/1978 | Joelson | 249/100 |
| 4,437,640 | 3/1984 | Heinzle | 249/65 |

*Primary Examiner*—Jay H. Woo
*Assistant Examiner*—James P. Mackey
*Attorney, Agent, or Firm*—Baker & McKenzie

[57] ABSTRACT

The invention relates to seals on equipment used to make concrete pipe. Such equipment includes two generally vertical cylindrical surfaces, a core and a mold, with upper and lower end forming rings. The lower end forming ring, a pallet, has inner and outer vertical surfaces. Seals of the present invention are formed by using two hollow tubes of soft rubber. The tubes are housed in lower portions of the core and the mold so that they are in alignment with the inner and outer surfaces of the pallet. The tubes are pressurized into tight engagement with the pallet to prevent the outward flow of slurry from the space between the core and the mold.

5 Claims, 2 Drawing Sheets 34
10
12
18
28
14
22
16
26
24
32
20
36
30

APPARATUS FOR MAKING CONCRETE PIPE

BACKGROUND AND SUMMARY OF THE INVENTION

The present invention relates to a machine for use in making concrete pipe. In particular, the invention relates to a seal for containing the slurry which is created during vibration of concrete mixes used to make concrete pipes. The seal of the present invention allows for improved quality in the manufacture of concrete pipe, in both dry cast and wet cast processes.

The most common method of forming concrete pipe entails the use of vertically oriented cylindrical forms. The form, or outer jacket (sometimes referred to as a mold), is used to form the outside surface of the concrete pipe, while a core is used to form the inside surface of the pipe. Ring-like forming equipment is used to create male and female connections at the opposite ends of the concrete pipe. A pallet is used to form the lower female end, while a cap is used to form the upper male end. Reinforcing bars, commonly referred to as a cage, may be used in some cases to form a pipe of increased strength.

Generally, the first step in the concrete pipe manufacturing process is to form a cage and place it onto a pallet. The pallet and cage are placed over a core. Lifting feet extend outwardly from the bottom of the core to engage the underside of the pallet so that when the core is lifted the core, cage and pallet are raised as a unit. That assembly is then lowered into place within a form. The assembly is then ready for the placement of concrete between the form and the core around the bars comprising the cage. To ensure the complete flow of concrete and to avoid the formation of voids, vibrating equipment is generally used to enhance the flow of the concrete mix. Such vibration causes the concrete mix to consolidate or densify. Vibration of the concrete mix results in the formation of a slurry, i.e. a combination of water, cement paste and fine sand in suspension. The slurry, being generally a liquid-like material, tends to flow through available cracks or opening. Vibration and the resulting slurry are present both in wet and dry casting processes.

In dry casting, once the form is filled with concrete and the cap has been placed around the top to form the male end of the pipe, the pipe is separated from the form. The separation is accomplished by lifting the core and pipe out of the form. The pipe and core are then separated by retracting the core feet and withdrawing the core from the pipe.

In wet casting, once the form is filled with concrete and the cap has been placed around the top to form the male end of the pipe, the pipe, form, core, cap and pallet are left for the concrete to cure. Once the concrete has cured sufficiently, the pipe is then separated from the mold, core, cap and pallet.

The processes explained above have been used for many years and are generally accepted and effective methods of forming concrete pipe. However, because of the relative vertical movement required to separate the various components of the manufacturing system, the formation of an effective seal between the core and the pallet, and between the pallet and the form has been a significant problem. Compression seals are used in some cases. However, such seals have generally been used in connection with ledges, such that generally horizontal opposing surfaces are used to compress an elastomeric material. Such a sealing arrangement relies on the gravitational force created by various components of the system, making the design of an effective seal largely dependent on factors which cannot be varied, i.e. the weight of the respective components.

The use of ledges to support the elastomeric material comprising the compression seal creates problems of interference when separating the components of the system is required. A ledge-type support for a seal may only be used at one of the two sealing locations, i.e. the inner or the outer edge of the pallet.

In addition, the ledges used to support compression seals, and the upwardly facing grooves in which the seals rest, provide a place for significant buildup of excess slurry. The excess slurry hardens under the compression seals and creates an uneven base upon which the seal rests, unless the upwardly facing grooves are cleaned after each use. As a result of the difficulty in obtaining an effective seal at the lower regions of a concrete pipe forming assembly, significant losses of slurry can occur. Substantial losses of slurry can result in weak sections within the resulting concrete pipe which may, in addition, have poor appearance.

Therefore, it is an object of the present invention to provide a concrete pipe making system in which loss of slurry is substantially reduced or eliminated.

Another object of the present invention is to provide a concrete pipe making system in which an effective and reliable seal is capable of being formed at the interfaces between the pallet and the core, and between the pallet and the form.

Still another object of the invention is to provide a method of forming concrete pipe which is substantially free of structurally weakened areas which are the result of excessive loss of slurry.

Still another object of the invention is to provide a method of forming concrete pipe having uniform appearance.

These and other objects of the invention may be achieved with a concrete pipe making system which utilizes laterally expandable seals which close the gap between the pallet and the core, and between the pallet and the form of a pipe making apparatus. The laterally expandable seals are comprised of two annular hollow tubes made of a resilient elastomeric material. These annual sealing elements are housed within grooves formed on the lower portions of the core and form. The hollow sealing components are expanded by the insertion of fluid (gas or liquid) to cause expansion of the sealing component out of the groove into engagement with vertical inner and outer surfaces of the pallet. Once the sealing components have been pressurized, vibration of the concrete pipe forming apparatus can proceed without danger of loss of slurry. After vibration and the resulting densification of the concrete mix has occurred, the sealing components may be depressurized and the various components of the apparatus can be separated in accordance with standard pipe forming techniques.

The objects and advantages of the present invention will be better understood upon a reading of the following specification in conjunction with the accompanying drawings, wherein:

DETAILED DESCRIPTION OF THE INVENTION

Figure 1:
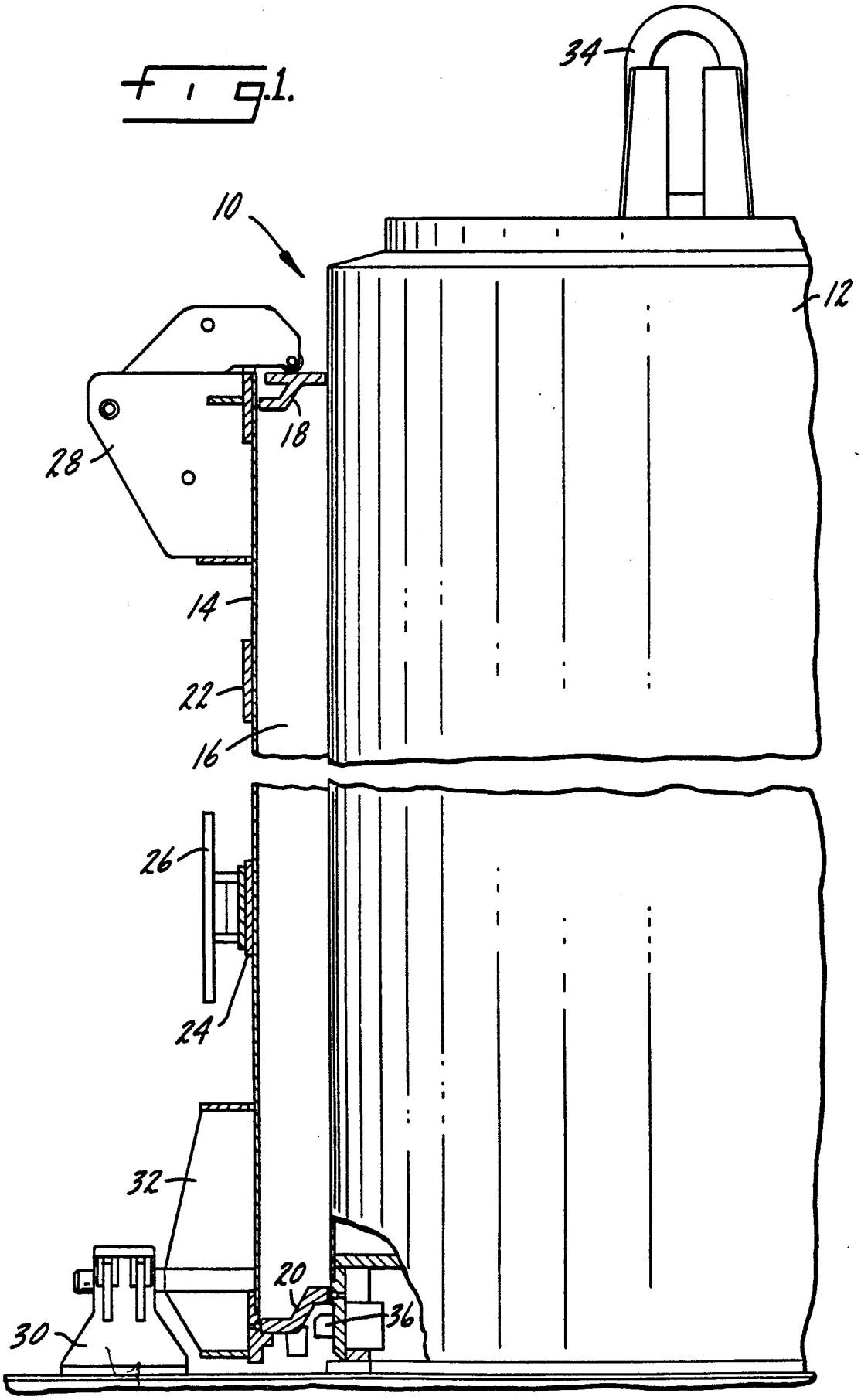
FIG. 1 is an elevational in partial section of a pipe forming apparatus of the present invention.

FIG. 1 shows a concrete pipe forming apparatus 10, which is comprised of a core 12 and a form 14 (sometimes referred to herein as a mold.) A chamber 16 is created by the space between the core 12 and the form 14. A cap 18 bounds the upper portions of the chamber 16, while a pallet 20 forms the lower boundary of the chamber 16. An upper band 22 and a lower band 24 reinforce the relatively thin wall of the form 14. A vibration mount 26 is attached to the lower band 24. A cap positioner 28 is used to retain the cap 18 in its proper position. Support feet 30 carry the form 14 through gussets 32. A lifting bale 34 is used to move the core 12 from one position to another. Retractable lifting feet 36 are carried by the bottom portion of the core 12.

A vibrator (not shown) disposed within the core 12, is used to densify and consolidate the concrete as it is placed in the chamber 16. A supplementary vibration device (not shown) may be connected to the vibration mount 26 on the exterior of the form 14 to provide additional densification and consolidation of the concrete mixture. As a result of vibration of the core 12 and/or the form 14, a situation akin to a "quick condition" occurs in which the water, cement and finer sand particles in the concrete mixture tend to flow freely. During vibration, any material small enough to fit between the space between the pallet 20 and the core 12, or the pallet 20 and the form 14, will tend to bleed out of the chamber 16.

Figure 2:
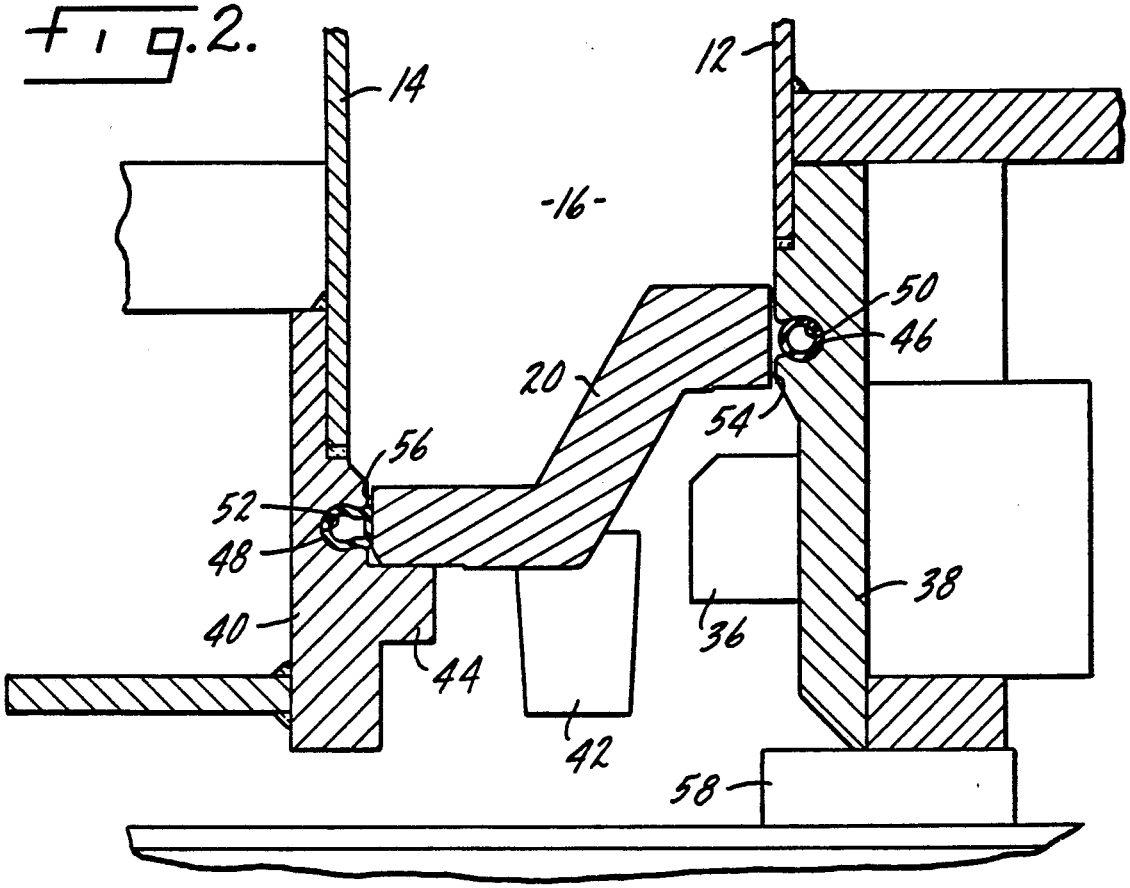
FIG. 2 is an enlarged sectional view showing a sealing arrangement of the present invention.

FIG. 2 is an enlarged sectional view of the pallet 20 shown in FIG. 1 and the adjacent components of the form 14 and the core 12. The core 12 has a core base 38 of thick material, in which is formed a groove 50. Similarly, the form 14 has a form base 40, in which is formed a groove 52. An inner seal 46 is disposed in the groove 50, and an outer seal 48 is disposed in the groove 52. The seals 46 and 48 are preferably made of a soft natural rubber having a durometer hardness (A scale) of approximately 40. The seals 46 and 48 will, upon pressurization, fill their respective grooves 50 and 52, and further expand into engagement with surfaces 54 and 56 on the inner and outer edges of the pallet 20.

Pallet support feet 42 hold the pallet 20 in a raised position. However, as shown in FIG. 2, a ledge 44 is used to support the pallet 20 relative to the form 14. The core 12 rests on a pallet block 58. In the embodiment shown in FIG. 2, the retractable core feet 36 may be used to lift the pallet and concrete out of the form 14 along with the core 12. Once the core 12, pallet 20 and concrete have been extracted from the form 14, the retractable core feet 36 can be retracted to allow the core 12 to be withdrawn from the concrete when it is fully set.

Figure 3:
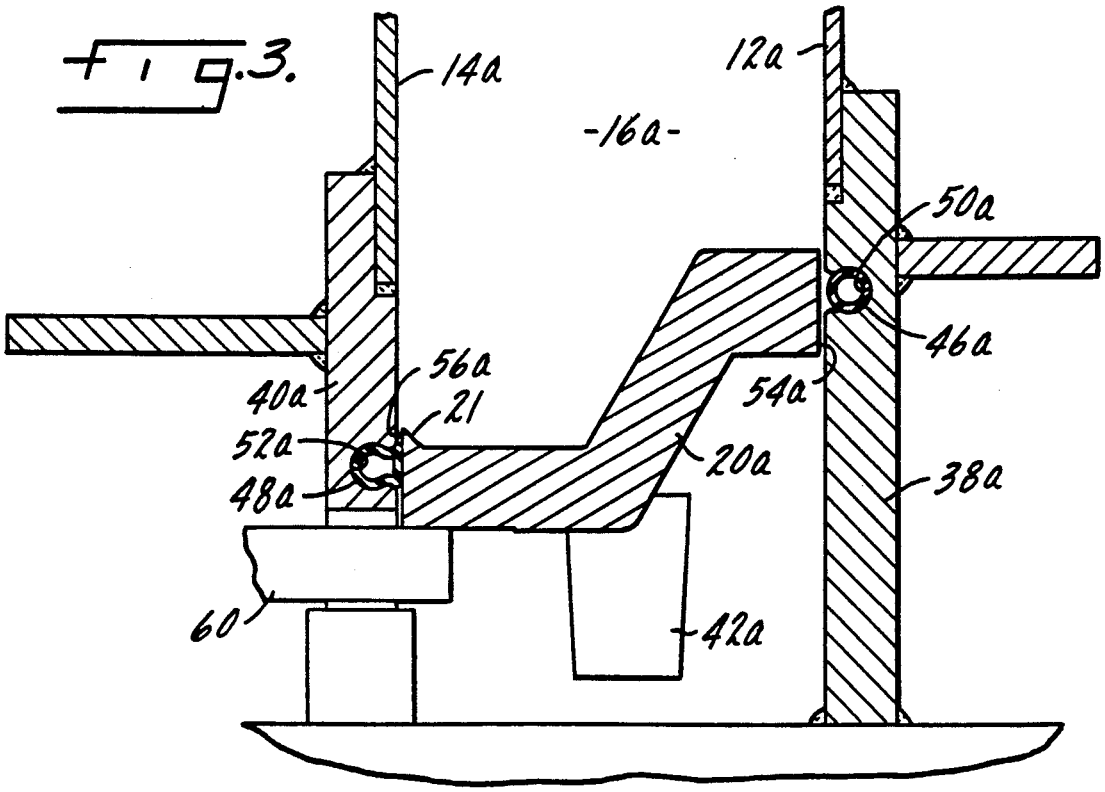
FIG. 3 is an enlarged sectional view of an alternative embodiment of a system utilizing the sealing arrangement of the present invention.

FIG. 3 shows an alternative embodiment of a form **14*a*, core 12*a*, and pallet 20*a*. (Reference numerals with the designation "a" are used in FIG. 3 on parts which correspond to similar parts referred to in FIG. 2.) The pallet 20*a* has a lip 21 on its outer edge to create a bevelled edge on the resulting concrete pipe. The presence of the lip 21 creates an enlarged outer surface 56*a* against which the seal 48*a* may bear. Moveable cleats 60 on the form base 40*a* allow the form 14*a* to be lifted vertically past the pallet 20*a*, an operation which is prevented by the ledge 44 in the embodiment shown in FIG. 2. As in the embodiment shown in FIG. 2, the embodiment of FIG. 3 includes an inner seal 46*a* carried by a groove 50*a*, formed in the core base 38*a*. The seal 48*a* is disposed in a groove 52*a*. The seals 46*a* and 48*a* are expandable into engagement with inner and outer vertical surfaces 54*a* and 56*a* on the pallet 20*a***.

Because the seals 46 and 48 of the present invention fit tightly into grooves 50 and 52, there is minimal accumulation of excess concrete material or slurry which might otherwise accumulate and make it difficult to achieve a consistent alignment of the pallet 20, form 14 and core 12. A compression seal which lies in an upwardly facing groove would tend to gather and accumulate excess material which upon hardening would tend to create an uneven surface upon which the seal bears. The seals 50 and 52 of the present invention provide the further advantage of creating no interference problems to prevent the relative vertical movement of the form 14, concrete, pallet 20 and core 12.

Pressurization of the seals of the present invention can easily accomplished by utilizing a single length of tubing connected to a tee (not shown) which can extend through a drilled hole in the bottom of the respective groove which supports the seal. Standard fittings can be used to make the connection to line pressure at the site. It has been found that pressures of approximately 35 p.s.i. are sufficient to close a 1/16 inch gap when using a base having an outside diameter of $\frac{5}{8}$ inch and an inside diameter of $\frac{3}{8}$ inch (the wall thickness of the tube being $\frac{1}{8}$ inch). As the gap increases in 1/16 inch increments, incremental increases of pressure of 5 p.s.i. can be used to create a seal. In FIGS. 2 and 3, one of the seals (48 and **48*a*, respectively) are shown in the expanded or pressurized state. When pressurized, each of the seals 46, 48, 46*a*, and 48*a*** tightly presses against a vertical surface. In the unpressurized state, each of the seals is fully contained within its respective grooves so as to create no interferences with vertical movement of the components of the pipe making apparatus.

While a specific embodiment of the invention has been shown and described, numerous alternatives, modifications, and variations of the embodiment shown can be made without departing from the spirit and scope of the appended claims. For example, the grooves and seals of the present invention could be formed in and carried by the pallet instead of the lower ends of the core and form. Other variations are possible and will be apparent to those skilled in the art.

I claim:

1. A machine for making concrete pipe comprising a core and mold, said core and said mold providing surface forming means for forming inner and outer surfaces, respectively, of said pipe, pallet means for forming one end of said pipe, and tubular sealing means adjacent to said pallet means for limiting outflow of fluids from areas between said core and said pallet means, and from between said mold and said pallet means, said tubular sealing means being capable of being internally pressurized and radially expanded to form seals between said core and said pallet and between said mold and said pallet.

2. A machine for making concrete pipe in accordance with claim 1 wherein:

said sealing means comprises two radially moveable hollow tubes, a first tube forming an inner seal between said pallet means and said core, and a second tube forming an outer seal between said pallet means and said mold.

3. A machine for making concrete pipe in accordance with claim 2 wherein:

said first tube is carried by said core, and said second tube is carried by said mold, said first and second tubes being housed in first and second grooves formed on bottom vertical surface of said core and said mold, respectively.

4. A machine for making concrete pipe in accordance with claim 3 wherein:

said grooves are shaped so as to contain said tubes in an unpressurized state whereby said tubes avoid interfering with objects moving near said grooves when said tubes are in said unpressurized state.

5. A machine for making concrete pipe comprising a core and mold, said core and said mold providing surface forming means for forming inner and outer surfaces, respectively, of said pipe, pallet means for forming one end of said pipe, and moveable sealing means adjacent to said pallet means for limiting outflow of fluids from areas between said core and said pallet means, and from between said mold and said pallet means, said sealing means comprising first and second tubes, capable of being internally pressurized to form first and second seals, said first tube being carried by said core, and said second tube being carried by said mold, said first and second tubes being housed in first and second grooves, respectively, said grooves being disposed at lower portions of said core and said mold, and said grooves being shaped so as to contain said tubes in an unpressurized state whereby said tubes avoid interfering with objects moving near said grooves when said tubes are in said unpressurized state.

* * * * *